United States Patent [19]

Tuttle

[11] Patent Number: 4,940,239

[45] Date of Patent: Jul. 10, 1990

[54] EDUCATIONAL BOARD GAME APPARATUS AND METHOD OF USING SAME

[76] Inventor: John O. Tuttle, P.O. Box 941547, Schaumburg, Ill. 60194

[21] Appl. No.: 272,111

[22] Filed: Nov. 16, 1988

[51] Int. Cl.[5] ..... A63F 3/00

[52] U.S. Cl. ..... 273/243

[58] Field of Search ..... 273/243, 256, 257, 248, 273/249, 242

[56] References Cited

U.S. PATENT DOCUMENTS

| | | | |
|---|---|---|---|
| 3,104,106 | 9/1963 | Kenney et al. | 273/249 |
| 3,815,919 | 6/1974 | Cain et al. | 273/249 |
| 3,939,578 | 2/1976 | Coffey | 273/243 X |
| 4,124,214 | 11/1978 | Pavis | 273/249 |
| 4,273,337 | 6/1981 | Carrera et al. | 273/243 |
| 4,363,628 | 12/1982 | Kirkpatrick et al. | 273/256 X |
| 4,557,485 | 12/1985 | Lardon | 273/249 |
| 4,625,970 | 12/1986 | Childs et al. | 273/257 |

*Primary Examiner*—Edward M. Coven
*Assistant Examiner*—William E. Stoll
*Attorney, Agent, or Firm*—Bernard L. Kleinke; Jerry R. Potts; William P. Waters

[57] ABSTRACT

The game apparatus includes a plurality of player position marking pieces, a game board having a playing area with an endless path arranged to divide symmetrically the playing area into smaller areas for receiving individual decks of question and answer playing cards. The path is divided into interconnecting subdivisions and includes category and bonus indicia on the subdivisions. Each one of the playing cards contains a quotation or a definition with a missing word on one side, and the correct missing word to complete the quotation or definition on the reverse side of the card. The playing cards are divided into subject matter categories that are distinguishable from one another and are placed according to categories into the smaller areas on the playing board. The position marking pieces are initially placed on the game board on any subdivision bearing a bonus indicia, and thereafter are moved manually traveling along the path in any desired direction where only the number of subdivisions is determined by a move determining device and the player successfully completes a selected quotation or definition by identifying a missing word.

12 Claims, 3 Drawing Sheets

FIG. 1
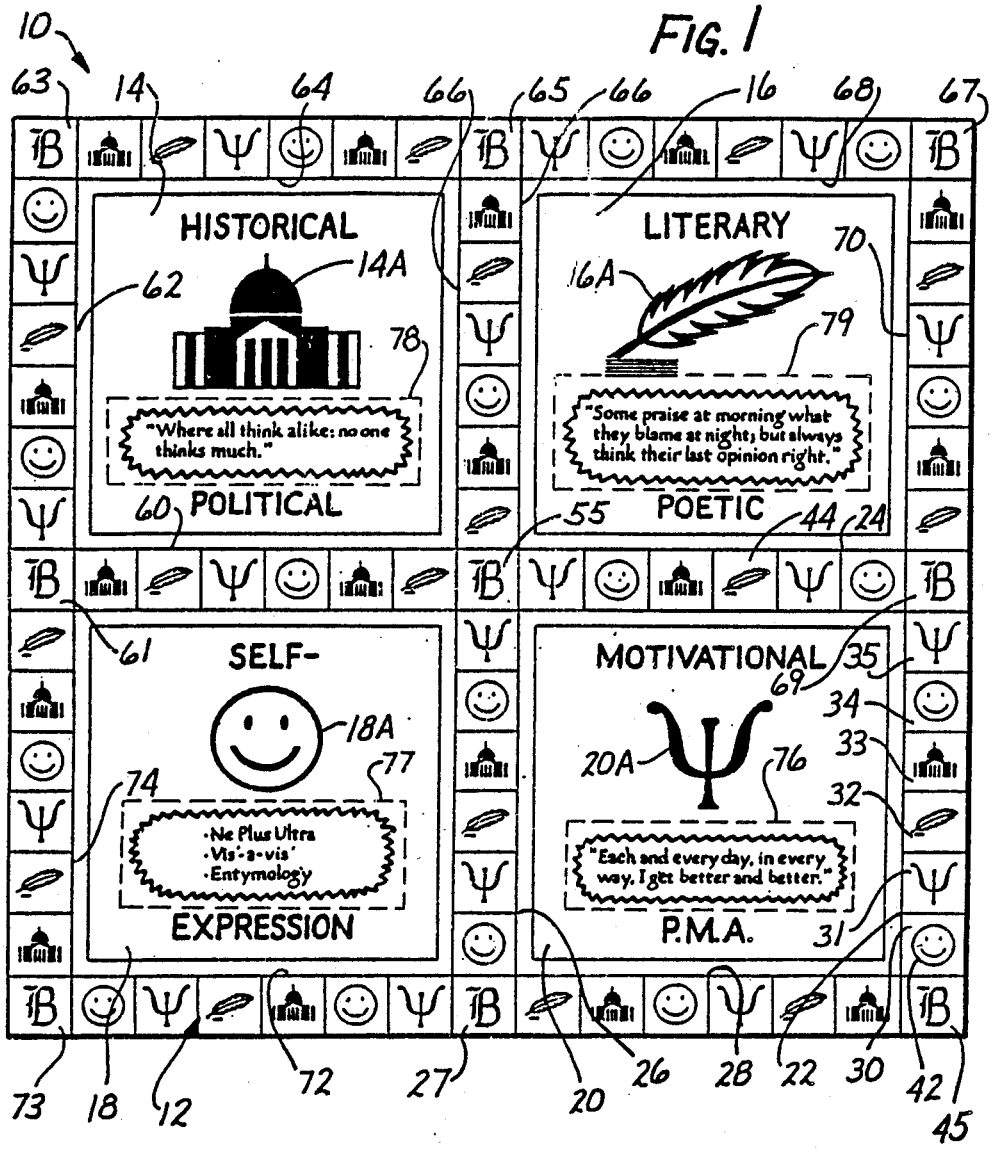
FIG. 2
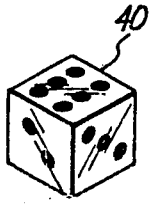
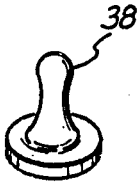
FIG. 3

SELF-EXPRESSION (Front Side)

FILL IN THE BLANK

Because it is from the opposite political party, his views would be considered (blank) --- (from a one-sided point of view).

(Back Side)

ANSWER:

Exparte /eks-part-e/ (adv. or adj.)

M-C: a) unfounded
(b) exparte
c) untrue

52

(Front Side)

FILL IN THE BLANK

He's the (blank) --- (the most typical example or representative) --- of an honest man.

(Back Side)

ANSWER:

Quintessence /kwin-tes-uns/ (n)

M-C: (a) quintessence
b) model
c) forerunner

53

MOTIVATIONAL (Front Side)

FILL IN THE BLANK

Mark Twain said, "Few things are harder to put up with than the annoyance of a good (blank)."

(Back Side)

ANSWER:

Example

M-C: a) meal
b) lawsuit
(c) example

48

(Front Side)

FILL IN THE BLANK

F.M. Hubbard said, "Being (blank) after you've got everything you want doesn't count."

(Back Side)

ANSWER:

Optimistic

M-C: a) magnanimous
(b) optimistic
c) wrong

49

FIG. 4

HISTORICAL (Front Side)

FILL IN THE BLANK

S. Friedman said, "Nepotism is the theory of (blank)."

(Back Side)

ANSWER:

Relativity

M-C: a) evolution
(b) relativity
c) creation

46

(Front Side)

WHO SAID . . .

"I know not what course others may take; but for me, give me liberty or give me death."

(Back Side)

ANSWER:

Patrick Henry

M-C: a) Nathan Hale
b) John Wilkes Booth
(c) Patrick Henry

47

LITERARY (Front Side)

FILL IN THE BLANK

Ellen Glasow said, "He knows so (blank) and knows it so fluently."

(Back Side)

ANSWER:

Little

M-C: a) much
b) much-of-importance
(c) little

50

(Front Side)

FILL IN THE BLANK

B. Goddard said, "There must be something to (blank) - you never see any sick porcupines."

(Back Side)

ANSWER:

Acupuncture

M-C: a) Veterinary-Medicine
(b) Acupuncture
c) Immunity

51

FIG. 5

EDUCATIONAL BOARD GAME APPARATUS AND METHOD OF USING SAME

TECHNICAL FIELD

The present invention relates in general to a game, and it more particularly relates to a board game apparatus, which includes a game board, playing cards, position marking pieces and a move-determining device.

BACKGROUND ART

There have been many different types and kinds of board games. For example, question-answer board games have been used for amusement purposes. Such games have typically included a game board, playing cards, position marking pieces, and a move determining device.

Other types and kinds of board games used for purposes have also been known to stimulate the interest of users. They have included devices for prompting a player to fill in a missing word, phrase or the like. For example, reference may be made to the following U.S. Pat. Nos.: 4,715,608; 4,607,848; 4,273,337; 4,201,388; 3,143,348; 3,081,088; and 1,327,019.

In U.S. Pat. No. 4,201,388, there is disclosed game apparatus which represents one of the typical question-/answer games. The patented game includes corresponding sets of question and answer cards, with the question cards containing a biblical quotation or scripture passage with certain words omitted therefrom, corresponding to certain correct answer words among a group of possible answer words, (multiple-choice) which are provided. A game board includes a path of travel, extending from a starting position and terminating at a finishing position. A position determining device, such as a die or spinner, indicates the movement of markers along the path of travel. Such a game must have a large game board for accommodating such a long, sprawling pathway. Such a large game board is sometimes awkward to use. For example, it is difficult to play such a game, while traveling in a vehicle, due to the size of the game board. Also, when it is desired to be used in confined areas, such as automobiles, the long, sprawling pathway with numerous board indicia, all of the players may not be able to read the board indicia in a convenient manner, in order to complete the game successfully.

It would, therefore, be highly desirable to have a board game apparatus which includes a compact sized game board, having a simple format, which would enable the game apparatus to be used in close quarters, such as the interior of a vehicle, and which is educational and self-improvement orientated by including cognitively oriented questions to be answered as a part of the game.

However, the game should be interesting and informative to play, should use the question and answer format, and should have new and unique categories of questions.

Other types of interesting question and answer board games have attempted to provide a large number of categories of questions for player challenge. For example, the game sold under the tradename "TRIVIAL PURSUIT", includes storage boxes filled with a large number of question and answer playing cards which may be individually retrieved from the box during the progress of the game. The trivia questions are divided into a number of categories.

By having the playing cards stored in a large box separate from the game board, such an arrangement is awkward, especially where space is confined. In this regard, while traveling in a vehicle, such a large box of cards is not always convenient to use. Moreover, the game board includes a sprawling pathway having starting and finishing positions, and such a board only serves to compound the problem of a large playing card box.

The TRIVIAL PURSUIT game board apparatus not only includes a sprawling pathway having starting and finishing positions, but also includes multiple small puzzle-like pieces to complete a design, in order to complete the game. The large board, along with numerous small pieces only serve to compound unduly the problem of playing the game in compact quarters. Also, this is a trivia question game, and generally would not be considered as an educational instrument.

Therefore, it would be highly desirable to have a truly educational and self-improvement type question and answer board game, which provides the players with a sizeable number of unique question categories, and which has a compact board game and convenient to use playing card storage facilities. Such playing card storage facilities should utilize question/answer cards, which could be easily and conveniently stored and retrieved for play during the course of the game. In this manner, such a novel game could utilize categorized question and answer cards, not be overburdened with numerous small easy-to-lose pieces, yet be educational and self-improvement in manner and should develop very different cognitive processes, skills, and knowledge (compared to the other games) and could be used in confined quarters, such as vehicles.

DISCLOSURE OF INVENTION

Therefore, it is the principal object of the present invention to provide a new and improved game, which employs categorized question and answer playing cards or the like, and which is compact in size and able to be played in confined quarters.

Another object of the present invention is to provide such a new and improved game which provides compact and convenient to use playing card storage facilities, without the necessity of a separate storage box during game play.

Yet another object of the present invention is to provide such a game, which is truly educational and self-improvement in manner, with non-trivia type questions, and which has question categories not found in other games to provide a fun and exciting method of educational self-enhancement and self-enrichment in cognitively important areas of American life, not found in other board or video games.

Briefly, the above and further objects are realized in accordance with the present invention by providing a small, compact game board having a substantially flat playing area thereon being divided into smaller symmetrically positioned areas for receiving and supporting question and answer playing card stacks arranged according to categories of questions. Thus, the playing cards are arranged in a plurality of separate decks, which are placed on the playing board in a convenient manner, without the need for a large separate box. To reiterate, the inventive game apparatus is compact in size and can be conveniently played while riding in vehicles or in other such close quarters, and yet is an interesting and cognitively informative question and answer type game, with a multiplicity of categories of questions that are educational and self-improvement in manner. The "questions" in the inventive game develop very different cognitive (intellectual) processes, skills, and knowledge in the players, as compared to other prior known games.

Subdivisions surround the smaller areas and define pathways for markers to be positioned as they are moved therealong. The smaller areas and the subdivisions bear category indicia corresponding to the categories of the questions on the playing cards. Bonus indicia on at least one of the subdivisions of the board permit the players to select any one of the categories of playing cards, as well as serve as starting locations for playing pieces. The playing cards are color and letter coded for each category. The faces of the cards bear quotation or definition indicia, with each card generally having at least one blank space requiring an answer by the player selecting the card. In operation, prior to the play of the game, four stacks of playing cards are placed answer down on the small designated areas of the playing board, so that cards may be drawn from the bottom or mid-portion of the deck during the play of the game. Thus, a quantity of each of the quotation subject matter category cards are positioned within their respective category indicia areas on the playing board, in a compact manner. Play time of the game is determined by the players prior to starting the game, either by selecting a given number of questions to be answered correctly, or by selecting a given playing time.

Play is started by each of the players selecting one of the bonus indicia to position his or her position marking piece. During playing of the game, each player, in turn, moves his or her position marking pieces along the subdivisions forming the pathway in accordance with a move determining device, such as a die. When the marker or playing piece comes to rest on one of the subdivisions bearing a category indicia, one playing card is retrieved from the corresponding category deck.

The quotation indicia on the card is then read so the player may have the opportunity to answer by verbally giving the correct word to complete the quotation or to complete the definition. If the player successfully provides the correct answer, the player is afforded another opportunity to repeat the above described process until the player gives an unacceptable answer, or until the selected number of points is accumulated by the player, or the playing time for the game elapses.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein:

FIG. 1 is a plan view of a game board of the game apparatus constructed in accordance with the present invention;

FIG. 2 is a pictorial view of a move determining device of the game apparatus of FIG. 1;

FIG. 3 is a pictorial view of one of the position marking pieces representing the game players of the game apparatus of FIG. 1;

FIG. 4 illustrates enlarged plan views of the front and back faces of representative ones of two of the categories of the playing cards used in the game apparatus of FIG. 1; and FIG. 5 illustrates enlarged plan views of the front and back faces of representative ones of two additional categories of the playing cards used in the game apparatus of FIG. 1.

BEST MODE FOR CARRYING OUT THE INVENTION

Referring now to the drawings, and more particularly to FIG. 1 thereof, there is shown a game board 10, which is a part of game apparatus constructed in accordance with the present invention, and which is used in accordance with the method of the present invention.

The relatively small and compact game board 10 has on its face a generally square shaped playing area 12, and within the playing area 12 a group of four smaller square shaped card position areas 14, 16, 18, and 20, each bearing question subject matter category indicia 14A, 16A, 18A and 20A, respectively.

Considering now the question subject matter category indicia 14A, 16A, 18A, and 20A in greater detail with reference to FIG. 1, the indicia 14A is representative of a capital building to designate the question subject matter category associated with political or historical questions. The indicia 14A further includes in a spaced apart manner from the capital building representation, two words, HISTORICAL and POLITICAL to further designate the question subject matter category. The word HISTORICAL is disposed above the capitol building representation, while the word POLITICAL is disposed below the capitol building representation. The indicia 14A also includes a quote disposed between the capitol building representation and the word POLITICAL to exemplify a typical quote that might be associated with the subject matter category.

Considering now the indicia 16A in greater detail with reference to FIG. 1, the indicia 16A is representative of a quill writing pen to designate the question subject matter category associated with literary or poetic questions. The indicia 16A further includes in a spaced-apart manner from the quill writing pen, two words LITERARY and POETIC to further designate the question subject matter category. The word LITERARY is disposed above the quill writing pen representation, while the word POETIC is disposed below the quill writing pen representation. The indicia 16A also includes a quote disposed between the quill writing pen representation and the word POETIC to exemplify a typical quote that might be associated with the subject matter category.

Considering now the indicia 18A in greater detail with reference to FIG. 1, the indicia 18A includes a representation of a happy face to designate the question subject matter category associated with self-expression questions. The indicia 18A further includes in a spaced apart manner from the happy face representation the hyphenated word SELF-EXPRESSION to further designate the question subject matter category. The hyphenated word portion SELF- is disposed above the happy face representation, while the rest of the hyphenated word, EXPRESSION, is disposed below the happy face representation. The indicia 18A also includes a set of words disposed between the happy face representation and the word EXPRESSION to exemplify a typical words that might be associated with the subject matter category.

Considering now the indicia 20A in greater detail with reference to FIG. 1, the indicia 20A includes a representation of a motivational indicia to designate the question subject matter category associated with motivation or P.M.A. questions. The indicia 20A further includes in a spaced apart manner from the instruction indicia representation two expressions, MOTIVATIONAL and P.M.A. to further designate the question subject matter category. The expression MOTIVATIONAL is disposed above the motivational indicia representation, while the expression P.M.A. is disposed below the motivational indicia representation. The indicia 20A also includes a quote disposed between the motivational indicia representation and the expression P.M.A. to exemplify a typical quote that might be associated with the subject matter category.

A plurality of interconnected pathways, such as pathways 22, 24, 26 and 28 surround the smaller areas, such as the square shaped area 20. The pathways are divided into squares or subdivisions, such as the squares 30, 31, 32, 33, 34, and 35 of the pathway 22.

Considering now the pathways in greater detail with reference to FIG. 1 the area 14 is surrounded by four pathway segments 60, 62, 64 and 66. The common pathway 60 extends along the bottom edge of area 14 and separates the bottom edge of area 14 from the top edge of area 18. The common pathway 60 is connected at its left edge to the left pathway 62. A bonus indicia 61 is disposed adjacent to both the common pathway 60 and the left pathway 62. The left pathway extends along the left edge of the area 14, and is connected to the left edge of the top pathway 64. A bonus indicia 63 is disposed adjacent to both the left pathway 62 and the top pathway 64. The top pathway 64 extends along the top edge of area 14 and is connected at its right edge to the common pathway 66. A bonus indicia 65 is disposed adjacent to both the top pathway 64 and the common pathway 66. The common pathway 66 extends along the right edge of area 14 and separates the right edge of area 14 from the left edge of area 16. The common pathway 66 is connected to the right edge of common pathway 60. A bonus indicia 55 is disposed adjacent to both the common pathway 66 and the common pathway 60.

Considering now the area 16 in greater detail with reference to FIG. 1, the area 16 is surrounded by four pathway segments 24, 66, 68 and 70. The common pathway 24 extends along the bottom edge of area 16 and separates the bottom edge of area 16 from the top edge of area 20. The common pathway 24 is coextensive with common pathway 60 and is connected at its left edge to the common pathway 66. The bonus indicia 55 is disposed adjacent to both the common pathway 24 and the common pathway 66.

The common pathway 66 extends along the left edge of area 16 and is connected to the left edge of top pathway 68. The bonus indicia 65 is disposed adjacent to both the common pathway 66 and the top pathway 68. The top pathway 68 extends along the top edge of area 16 and is connected at its right edge to the right pathway 70. A bonus indicia 67 is disposed adjacent to both the top pathway 68 and the right pathway 70. The right pathway 70 extends along the right edge of area 16 and is coextensive with the right pathway 22. The right pathway 70 is connected to the right edge of common pathway 24. A bonus indicia 69 is disposed adjacent to both the right pathway 70 and the common pathway 24.

Considering now the area 20 in greater detail with reference to FIG. 1, the area 20 is surrounded by four pathway segments 28, 26, 24, and 22. The bottom pathway 28 extends along the bottom edge of area 20 and is connected at its left edge to the common pathway 26. A bonus indicia 27 is disposed adjacent to both the bottom pathway 28 and the common pathway 26. The common pathway 26 extends along the left side of area 20 and separates the left edge of area 20 from the right edge of area 18. The common pathway 26 is coextensive with common pathway 66 and is connected to the left edge of common pathway 24. The bonus indicia 55 is disposed adjacent to both the common pathway 26 and the common pathway 24. The common pathway 24 extends along the top edge of area 20 and is connected at its right edge to right pathway 24. A bonus indicia 69 is disposed adjacent to both the common pathway 24 and the right pathway 22. The right pathway 22 extends along the right edge of area 20 and is connected to the right edge of bottom pathway 28. A bonus indicia 45 is disposed adjacent to both the right pathway 22 and the bottom pathway 28.

Considering now the area 18 in greater detail with reference to FIG. 1, the area 18 is surrounded by four pathway segments 72, 74, 60 and 26. The bottom pathway 72 extends along the bottom edge of area 18 and is connected at its left edge to the left pathway 74. A bonus indicia 73 is disposed adjacent to both the bottom pathway 72 and the left pathway 74. The left pathway 74 extends along the left edge of area 18 and is coextensive with left pathway 62. The left pathway 74 is connected to the left edge of common pathway 60. The bonus indicia 61 is disposed adjacent to both the left pathway 74 and the common pathway 60. The common pathway 60 is connected to common pathway 26 and extends along the top edge of area 18. The bonus indicia 55 is disposed adjacent to both common pathway 60 and common pathway 26. The common pathway 26 extends along the right edge of area 18 and is connected to the right edge of bottom pathway 72. The bonus indicia 27 is disposed adjacent to both the common pathway 26 and the bottom pathway 72. It should therefore be understood that a subdivision with a bonus indicia disposed thereon is disposed adjacent to the corner of each respective playing card area and with one of said subdivisions being disposed on the geometric center of the playing board.

Considering now the playing cards in greater detail with reference to FIGS. 1, 4 and 5, four categories of playing cards 76, 77, 78 and 79 are illustrated in FIG. 1, with representative ones of the cards shown in FIGS. 4–5. The decks 76, 77, 78 and 79 may rest face up, with the answers facing downwardly, on the board 10 within the corresponding card position areas 14, 16, 18 and 20 on the face of the board 10. The players may draw cards from the bottoms of the decks to conceal the questions indicated from view, until it is read by a player. The answer is shown on the back side of the card.

As in FIG. 3, a plurality of differently colored movable position-marking pieces, such as the piece 38, are distributed among the players of the game, and the pieces are manually movable from one to another of the subdivisions. As shown in FIG. 2, a move determining device in the form of a die 40 is used to ascertain at random the number of moves of the pieces along the subdivisions on the board 10.

A plurality of pathway category indicia such as a category "SELF-EXPRESSION" indicia 42 of path 22, designates that a playing card pertaining to a self-expression quotation is to be answered by a player whose position-marking piece, such as piece 38, is moved and brought to rest on such subdivision. The pathway indicia correspond to the four playing card resting area representation indicia of indicia 14A, 16A, 18A and 20A, to help identify the deck of cards to be used. Other pathway category indicia, such as "LITERARY" indicia 44 of path 24, indicate when a piece or pawn lands thereon that the card position area 16 bearing the indicia 16A, is to be referred to for drawing the card therefrom to be answered.

A plurality of "BONUS" such as indicia 45, 27, 73, 61, 63, 65, 67, 69 and 55, are provided to interconnect each pathway on the board 10, and designates that any one of the card position areas 14, 16, 18 or 20 may be referred to for a playing card, and that an extra or bonus point will be awarded for a correct answer. Also, at the start of the game, the playing pieces are positioned on different ones of the subdivisions bearing BONUS indicia. It should be noted that, in accordance with the present invention, there is no finishing point along the pathway, since the game is completed only after the playing time has expired, or a total number of points has been achieved.

In accordance with the method of the present game, the players manually move their pieces, such as the piece or pawn 38, along the paths interconnecting the subdivisions of the board 10 in accordance with the rolling of the die 40 of FIG. 2. As hereinafter described in greater detail, the players each acquire points for correct answers as they move along the paths on the face of the board 10 with their playing pieces. Points are acquired when a player reads aloud the quotation or definition indicia on the playing card and successfully supplies the correct and missing part of the quotation indicia. The missing part of the quotation, or the correct defining word, or person's name, is the correct answer, depending upon the category or type of "question" on the card. Thus, either the missing part of the quotation indicia, or the correct word indicia or name indicia is the answer. Bonus points are acquired in the same manner when a player provides a correct answer while his or her position marking piece rests on a subdivision with a bonus indicia, such as the indicia 45.

The player who accumulates the most points during the game wins, if a timed game is played, or alternately, the player to first collect a given number of points wins, if a point game is played.

Cards

There is a group of historical/political quotation cards such as cards 46 and 47, which is placed face up on the board at the beginning of the game. Each historical/quotation card has a value of one (1) or two (2) (if bonus) points.

There are a plurality of motivational/P.M.A. quotation cards such as cards 48 and 49, which is placed face up on the board at the beginning of the game. Each motivational/P.M.A. question card has a value of one (1) or two (2) (if bonus) points.

There are a plurality of literary/poetic quotation cards such as cards 50 and 51 which are placed face up on the board at the beginning of the game. Each literary/poetic question card has a value of one (1) or two (2) (if bonus) points.

There are a plurality of self-expression quotation cards such as cards 52 and 53 which are placed face up on the board at the beginning of the game. Each player retrieves a card from the bottom of the deck, to conceal the answer on the underside thereof. Each self-expression question card has a value of one (1) or two (2) (if bonus) points.

Playing Board

Considering now the board 10 of FIG. 1, a player whose piece comes to rest on a square with a feather (quill) indicia is entitled to draw a "LITERARY-POETIC" card from the literary card deck.

After rolling the die, a player whose piece comes to rest on a square with a happy face indicia is entitled to draw a "SELF-EXPRESSION" card from the self card deck.

A player whose piece comes to rest on a square with a capitol indicia is entitled to draw a "HISTORICAL-POLITICAL" card from the historical card deck.

A player whose piece comes to rest on a square with a PSYCHOLOGICAL SYMBOL indicia is entitled to draw a "MOTIVATIONAL-P.M.A." card from the motivational card deck.

A player whose piece comes to rest on a square with a letter B indicia, such as the indicia 45, is entitled to draw any one of the top cards from the above mentioned subject categories.

When a player's piece comes to rest on any one of the above mentioned squares or subdivisions, the PLAYING or NON-PLAYING moderator draws the category designated playing card and reads the quotation aloud. The reader says the word "BLANK" for the missing word in the quotation, or for the required word in the definition, or the like. The player then says the missing part of the quote or the word for the definition, etc., if the player knows the answer. Should the player be unable to supply the missing word in the quote or answers the "question" incorrectly, the correct answer is read by the reader and the playing card drawn is returned to the top of its stack of subject matter playing cards.

Game Play

To start the game, each player rolls the die to determine the order of play (highest number begins 1st, second highest next, etc.) Two players or up to six individual players may participate during the same game; and likewise, up to six teams may play. Any number of players may be on a team, i.e. one player against two or three players; or two players against two; or two, three, four, or five or more players per team, as in a classroom. The team players may confer on a question/answer before having the prior elected/chosen team captain give the answer.

Each player (or team of players) then chooses a colored position marking or playing piece and places it on any of the outer Bonus squares which are the starting point(s). As per the number rolled on the die, the playing piece is to be moved across (left or right) or up or down any of the categorically symboled squares of the four quadrants. The move must be made in the same direction (not a forward-backward or left-right or right-left combination during the same move). Right angle moves are always permitted. The exact number of squares must be taken as per the number rolled on the die. Any number of playing pieces may occupy the same square at the same time.

If a player (or team captain) playing piece comes to rest on any Bonus square, that player (or team captain) chooses the category, and any points scored count double.

Either a non-playing moderator/arbitrator, or a player acts as moderator/arbitrator, then reads the "question" (saying, quotation, or word/sentence) to the player(s). The reader must always read the word "blank" so that the listener can better understand the total meaning of the "question". All of the players (or team of players) generally elect or choose who shall be the playing (or non-playing) moderator/arbitrator for each game. The moderator/arbitrator has the ultimate authority to determine the "correctness" (acceptability) of an answer. There is no time limit per answer. However, prior to beginning (or during the game) a time limit per answer may be instituted, i.e., 15, 30, 45, 60 seconds, etc., as per agreement (or vote) among the players (or team of players). After a "question" has been read by the moderator/arbitrator, the player (or team captain) may ask the moderator/arbitrator to reread the "question", or, instead, may ask the moderator/arbitrator to hand the "question" card to him/her at which time the player him/her self must reread it aloud. When a player (or team of players) does not know the answer, a best guess should always be attempted, however, if his/her mind is momentarily blank, the player may say—"Pass". The "correct" answer must always be read aloud by the moderator/arbitrator when an "incorrect" (unacceptable) answer or no answer ("Pass") is given.

All but a few of the "questions" are the FILL IN THE BLANK type, with a small number of WHO SAID IT? type, EXPRESS THIS CONCEPT WITH ONE BEST WORD type, and TRUE OR FALSE type questions. In the Self-Expression category, there are a small number of DEFINE OR USE IN A SENTENCE type of questions. A common synonym is an acceptable answer for a definition, and, a common synonym is also generally an acceptable answer for the FILL IN THE BLANK type of questions in the other three categories.

Since nearly all of the "questions" are of the FILL IN THE BLANK type, the moderator/arbitrator does not need to read the identifying phrase—"FILL IN THE BLANK". However, on all other types of questions, the identifying phrase must be read, i.e., "WHO SAID . . . " etc. Also, in the Self-Expression category, FILL IN THE BLANK type questions, the reader must noticeably pause as indicated by the three hyphens which are just before and just after the definition(s) in the word/sentence(s). Then, the word/sentence should be immediately reread without the inserted definition—just the sentence reread with the reader also saying the word "blank" at the appropriate place.

The player may then ask to have the word/sentence reread (with the definition inserted), or, may ask the moderator/arbitrator for the question card, and then the player (or team captain) must, as above, reread it aloud.

One point is awarded (scored) for each correct (acceptable) answer. Two points are awarded for a correct (acceptable) answer given when the playing piece is on a Bonus square. Leniency in scoring is always recommended with the benefit of doubt going to the player(s).

When a correct (acceptable) answer is given to a question, the player (or team captain) rolls the die (40) again, and moves the playing piece the appropriate number of squares as per the roll. Another question card (saying, quotation, word/sentence) is given as per the category on which the playing piece lands (or player category choice).

After having attempted a question and the answer is incorrect (or unacceptable), then play is yielded by that player (or team captain), and the next player (or team captain) is given their next play. Play proceeds to the left. If per chance, a player (or team of players) should happen to continue without a miss to meet the game winning point (or time) requirements on the first turn, any player(s) who have not taken their first turn are allowed to try for a tie.

For scoring materials, a sheet of paper (not shown) is used, and a writing utensil (not shown). Score can be written with sticks notations as follows: Any player, or the non-playing moderator/arbitrator, can be chosen-/elected as the scorekeeper (tally).

To win (complete) a game, an individual player (or team of players) must accumulate a selected number of points, such as say, five points (or more). The more players (or teams of players) the less points to win is recommended and suggested. More experienced and/or more skilled players may want to require more points for a win.

A few short games seems to be preferable for the participants, as compared to one long game. The player (or team of players) who win the game, start the next game, and play proceeds to the left.

Scoring Option

Considering now optional or alternate forms of play of the game, the winning point(s) must be scored when the playing piece has landed on a bonus square such as BONUS square 45; or when the playing piece has landed on the BONUS Square 55 at the center of the board; or the category for the potential winning question/answer must be chosen by the moderator/arbitrator (in conjunction with either of the foregoing two options.) For a longer/shorter game, a larger or fewer number of points may be required to win a game as per agreement between the individual players (or team of players). Alternatively, a time limit for the game may be instituted per agreement between the players (or team of players , with the player or team with the most points at the end of the time limit, winning the game. However, each player and/or team must be allowed to complete his/her first turn only, around to the player or team who started the game, to determine the winner (with the most points).

Playing Option

An alternative multiple choice (M-C) playing method may be chosen as per agreement between the players. Play and scoring is as per the regular rules. However, upon reading the "question", the moderator/arbitrator then reads the three (3) choices on the reverse side of the playing card.

Accordingly, it is intended by the appended claims to cover all such changes and modifications as fall within the true spirit and scope of this invention.

While the particular embodiments of the present invention have been disclosed, it is to be understood that various different modifications are possible and are contemplated within the true spirit and scope of the appended claims. For example, while the game board 10 and the playing cards are made of paper board materials and printed indicia, it will become apparent to those skilled in the art that the game apparatus may be in the form of computer generated (video) images, or in the form of images projected onto a screen by a projector or in the form of a television game show. There is no intention, therefore, of limitations to the exact abstract or disclosure herein presented.

What is claimed is:

1. A game apparatus comprising:

a group of decks of playing cards having indicia means thereon configured in the shape of groups of characters forming questions and answers for game playing purposes according to game rules, said decks of cards each containing indicia means defining separate categories of question and answers;

a compact sized game board having a playing area;

said playing area having a plurality of playing card supporting areas for receiving said decks of cards for game playing purposes according to the game rules;

said playing area having path indicia means thereon, said path indicia means being configured in the shape of a plurality of path segments extending along the periphery of said playing card supporting areas and being interconnected in an endless path of travel;

said path segments being subdivided into a plurality of subdivisions;

a plurality of movable position marking player pieces distinguishable from one another and movable from one to another of said subdivisions along said path segments, said pieces being associated individually with the players of the game and being moved by their associated players;

move determining means presenting numerical values determining the move of the player pieces along said path segments;

indicia on the smaller areas of said game board indicative of where a portion of said playing cards are to be placed on the game board according to the game rules;

category indicia means on individual ones of the subdivisions of said game board for designating according to the game rules corresponding ones of the decks of playing cards;

means defining a plurality of common bi-directional starting positions, said means defining a plurality of common bi-directional starting positions being spaced in a random manner on selected individual ones of the subdivisions of said game board for designating player piece starting positions that can be occupied by any one of the player pieces according to the game rules;

means defining individual bi-directional subdivisions which can be occupied by any player piece and that can be approached from any direction according to the game rules;

said path segments including four inner segments and eight outer segments, each inner segment extending along a portion of the periphery of two of said playing card supporting areas to help define them, each outer segment extending along a portion of the periphery of one of said playing card supporting areas to help define it;

interconnecting means defining a common subdivision joining the ends of said inner segments for extending and for forming a portion of said endless path of travel therebetween;

said interconnecting means for permitting bi-directional movement of each of said player pieces between pairs of said inner segments, according to the game rules;

means defining four common subdivisions each connected between pairs of outer segments and the opposite ends of one of said four inner segments to extend and to form a portion of said endless path of travel; and said means of defining four common subdivisions for permitting bi-directional movement of each of said player pieces between pairs of outer segments and between an inner segment and the pairs of outer segments according to the game rules.

2. A game apparatus according to claim 1, wherein said playing card means includes different indicia being provided on each playing card.

3. A game apparatus according to claim 2, wherein said different indicia includes famous quotations with key words deleted therefrom, and sentences and definitions on one side of said playing cards and the deleted key words and answers to the sentences and definitions being disposed on the other side thereof.

4. A game apparatus according to claim 3, wherein said famous quotations and definitions are arranged in a plurality of subject matter categories distinguishable from one another.

5. A game apparatus according to claim 1, wherein the indicia on the smaller areas of said game board includes category indicia indicative of the subject matter categories of said playing cards.

6. A game apparatus according to claim 1, wherein the indicia on the subdivisions of said game board includes category indicia arranged in a plurality of sequential patterns along each endless path, each of said patterns being separated by a bonus indicia.

7. A game apparatus according to claim 6, wherein each sequential pattern includes at least one category indicia indicative of the subject matter categories of said playing cards.

8. A game apparatus according to claim 6, wherein the bonus indicia is arranged symmetrical on said game board.

9. A game apparatus according to claim 6, wherein the bonus indicia and category indicia are arranged along the endless path with a bonus indicia at the symmetrical center of the game board.

10. A game apparatus according to claim 1, wherein each playing card supporting area abuts four pathway segments configured in a square for surrounding said playing card area.

11. A game apparatus according to claim 10, wherein each playing card area further abuts four subdivisions, each subdivision having a bonus indicia thereon.

12. A game apparatus according to claim 11, wherein each subdivision having bonus indicia thereon is disposed adjacent to each respective corner of said playing card area.

* * * * *

UNITED STATES PATENT AND TRADEMARK OFFICE

CERTIFICATE OF CORRECTION

PATENT NO. : 4,940,239

DATED : July 10, 1990

INVENTOR(S) : John O. Tuttle

It is certified that error appears in the above-identified patent and that said Letters Patent is hereby corrected as shown below:

Column 10, line 8, after "their", delete "first", and substitute therefor --first--.

Column 10, line 12, after "as follows:", insert --~~iiii~~--.

Column 10, line 44, after "his/her", delete "first", and substitute therefor --first--.

Column 10, line 7, after "on the", delete "first", and substitute therefor --first--.

Signed and Sealed this

Eighth Day of September, 1992

*Attest:*

DOUGLAS B. COMER

*Attesting Officer*

*Acting Commissioner of Patents and Trademarks*